US008434957B2

(12) United States Patent
Kageyama

(10) Patent No.: US 8,434,957 B2
(45) Date of Patent: May 7, 2013

(54) KNOCK-TYPE WRITING INSTRUMENT

(75) Inventor: Hidehei Kageyama, Kawagoe (JP)

(73) Assignee: Kotobuki & Co., Ltd. (JP)

( * ) Notice: Subject to any disclaimer, the term of this patent is extended or adjusted under 35 U.S.C. 154(b) by 0 days.

(21) Appl. No.: 13/055,352

(22) PCT Filed: Jul. 13, 2009

(86) PCT No.: PCT/JP2009/062660

§ 371 (c)(1),
(2), (4) Date: Jan. 21, 2011

(87) PCT Pub. No.: WO2010/010825

PCT Pub. Date: Jan. 28, 2010

(65) Prior Publication Data

US 2011/0123250 A1 May 26, 2011

(30) Foreign Application Priority Data

Jul. 24, 2008 (JP) ..... 2008-191227

(51) Int. Cl.
*B43K 24/04* (2006.01)
*B43K 24/08* (2006.01)

(52) U.S. Cl.
USPC ..... 401/114; 401/99; 401/109; 401/112; 401/117

(58) Field of Classification Search ..... 401/65, 401/99, 104, 109, 112, 114, 117
See application file for complete search history.

(56) References Cited

U.S. PATENT DOCUMENTS

| | | | | |
|---|---|---|---|---|
| 3,037,483 | A * | 6/1962 | Caviglione | 401/104 |
| 4,365,390 | A * | 12/1982 | Kageyama et al. | 24/11 R |
| 4,968,167 | A * | 11/1990 | Kageyama | 401/31 |
| 6,447,193 | B1 * | 9/2002 | Kageyama et al. | 401/104 |
| 7,581,896 | B2 * | 9/2009 | Yoon | 401/106 |
| 7,677,824 | B2 * | 3/2010 | Yoon | 401/103 |
| 2009/0169285 | A1 * | 7/2009 | Cabatan | 401/109 |

FOREIGN PATENT DOCUMENTS

| | | |
|---|---|---|
| EP | 0 630 762 A1 | 12/1994 |
| FR | 1379338 | 10/1964 |
| JP | 03-70996 | 7/1991 |
| JP | 04-221700 | 8/1992 |
| JP | 3139755 | 2/2008 |
| WO | WO 94/05512 | 3/1994 |

OTHER PUBLICATIONS

International Search Report for PCT Application No. PCT/JP2009/062660; mailed Aug. 4, 2009; 2 pages.
Supplementary European Search Report for European Application No. 09 80 0339.5; issued Oct. 11, 2012; 2 pages.

* cited by examiner

*Primary Examiner* — Huyen Le
*Assistant Examiner* — Bradley Oliver
(74) *Attorney, Agent, or Firm* — Hiscock & Barclay, LLP

(57) ABSTRACT

A knock-type writing instrument is provided, which allows an easy refill exchange with a simple operation while inhibiting deformation of slits, breakage of a shaft tube, etc., during the refill exchange.

6 Claims, 10 Drawing Sheets

KNOCK-TYPE WRITING INSTRUMENT

CROSS REFERENCE TO RELATED APPLICATIONS

Pursuant to 35 USC §371, this application is a National Stage of International Application No. PCT/JP2009/062660, filed Jul. 13, 2009, which claims priority to Japanese Patent Application No. 2008-191227, filed Jul. 24, 2008 under applicable paragraphs of 35 USC §119, wherein the entire contents of each above-noted document is herein incorporated by reference.

TECHNICAL FIELD

The present invention relates to a knock-type writing instrument in which a refill is inserted into a shaft tube from the back end of the shaft tube.

BACKGROUND ART

This kind of knock-type writing instrument includes a knock-type instrument as disclosed in JP Utility Model Registration No. 3139755 by the applicant. This knock-type writing instrument comprises: a shaft tube having a long hole extending axially on its back peripheral wall; a refill having a writing part at its front end and inserted into the shaft tube from the back end of the shaft tube; a return spring biasing the refill backward; a knock member inserted into a back part of the shaft tube to allow its front end to abut the back end of the refill and allow its back part to protrude from the back end of the shaft tube; a resilient piece connected to the front end of the knock member to extend backward and capable of resiliently deforming in a radial direction of the shaft tube; a clip having a clip leg that is connected substantially orthogonally to a surface of the resilient piece and is slidably fitted in the long hole, the clip having a front part compressed into contact with or approaching an outer circumferential surface of the shaft tube; and a lock protrusion formed at the back end of the resilient piece and having a front surface inclined toward an interior of the shaft tube in a direction of the front end of the shaft tube.

In a knock-type writing instrument such as JP 3139755, a lock hole connected to the back end of the long hole via a middle slit as well as a back slit extending from the back end of the lock hole to the back end of the shaft tube are provided on the back peripheral wall of the shaft tube. The clip leg is fitted in the long hole via the lock hole and middle slit from the back slit. When the writing part of the refill is withdrawn within the shaft tube by a bias force of the return spring, the lock protrusion of the resilient piece is locked to the lock hole to maintain this withdrawn state of the writing part. When the back end of the knock member is knocked in such a withdrawn state of the writing part, the clip integral with the knock member and the refill advance, at which point the inclined front surface of the lock protrusion slidingly comes into contact with the inner wall surface of the middle slit, and the resilient piece resiliently deforms inwardly in the radial direction of the shaft tube. This causes the lock protrusion to pass through the middle slit to the long hole. When the lock protrusion moves to the long hole in this way, a resilient restoring force of the resilient piece causes the lock protrusion to be fitted in the long hole to lock the back end of the lock protrusion to the back end wall of the long hole. Thus, the writing part at the front end of the refill is maintained in a writable state in which it protrudes from the front end of the shaft tube.

In this writable state, when a surface of the clip is pressed (knocked), the resilient piece resiliently deforms inwardly in the radial direction of the shaft tube to release the lock of the back end of the lock protrusion to the back end of the long hole, and the refill and knock member are retracted by the bias force of the return spring. Then, when the lock protrusion moves to the lock hole, the resilient restoring force of the resilient piece causes the lock protrusion to fit in the lock hole to lock the back end of the lock protrusion to the back end of the lock hole, thereby maintaining the writing part in the withdrawn state within the shaft tube.

A knock-type writing instrument, such as JP 3139755, is intended to stably keep the writing part protruding from the front end of the shaft tube while increasing a resilient force of the clip, without increasing the number of components. In particular, the knock-type writing instrument of JP 3139755 is characterized in that, in order to stably keep the writing part protruding from the front end of the shaft tube, the lock protrusion, which is locked to the back end of the long hole while the writing part protrudes from the front end of the shaft tube, is formed at the back end of the resilient piece outwardly in the radial direction of the shaft tube. The long hole of the shaft tube is formed into a plane rectangular shape. The clip leg is formed to have a rectangular cross sectional shape as a surface shape in a direction in which its front and back ends are orthogonal to the shaft tube. With the writing part being withdrawn within the shaft tube, the bias force of the return spring causes the back end face of the clip leg to abut the back end face of the long hole in a surface contact state, such that the clip leg does not easily exit the long hole outwardly toward the back end of the shaft tube.

SUMMARY OF THE INVENTION

Problems to be Solved by the Invention

The knock-type writing instrument of JP 3139755 is configured as above. In particular, the entire clip leg is formed to have a rectangular cross-sectional shape as a surface shape in a direction in which its front and back ends are orthogonal to the shaft tube. By fitting the clip leg in the long hole with the plane rectangular shape, the clip leg cannot easily exit the long hole outwardly toward the back end of the shaft tube. Such a configuration is not intended to exchange refills. Thus, there has been a problem that, in order to exchange refills, the knock member must be forcedly moved with a considerable separation force in a direction in which the clip leg fitted in the long hole passes through the back slit via the lock hole from the middle slit so as to remove the knock member from the shaft tube. In such a knock member removal, because the middle and back slits are forcedly widened by the clip leg, there has been a problem that deformation of each of the slits, breakage of the shaft tube due to the forced widening of the slits, etc., are prone to occur. Therefore, there has been a problem that the knock-type writing instrument of Patent Document 1 cannot be easily implemented.

As a knock-type writing instrument other than that of JP 3139755, a common refillable ballpoint is well known, which has a configuration allowing an exchange of refills by removing a tip at the front end of a shaft tube or a tail crown at the back end of the shaft tube. However, since the exchange of refills needs repeated attachment and detachment of the tip or tail crown with respect to the shaft tube as mentioned above, there has been a problem that the refill exchange operation takes a lot of time and work.

The present invention was made to solve the above problems, and is intended to provide a knock-type writing instrument allowing an easy refill exchange with a simple operation while inhibiting the slit deformation, shaft tube breakage, etc., during the refill exchange.

Means for Solving the Problems

A knock-type writing instrument according to the invention comprises: a shaft tube having a long hole extending axially on its back peripheral wall; a refill having a writing part at its front end and inserted into the shaft tube from the back end of the shaft tube; a biasing member biasing the refill backward; a knock member inserted into a back part of the shaft tube to allow its front end to abut the back end of the refill and allow its back part to protrude from the back end of the shaft tube; a resilient piece connected to the front end of the knock member to extend backward and capable of resiliently deforming in a radial direction of the shaft tube; a lock protrusion formed at the back end of the resilient piece; and a clip having a clip leg connected to the resilient piece to be slidably fitted in the long hole, the clip having a front part compressed into contact with or approaching an outer circumference of the shaft tube; wherein a lock hole connected to the back end of the long hole via a middle slit as well as a back slit connected to the back end of the lock hole to reach the back end of the shaft tube are continuously formed on the back peripheral wall of the shaft tube in an extension direction of the back end of the long hole; and wherein the knock-type writing instrument is characterized in that the back end ridge is formed at the back end of the clip leg, the back end ridge sequentially widening the middle slit and back slit in their width directions by pushing out the clip toward the back end of the shaft tube with a pressure greater than a bias force of the biasing member.

The knock-type writing instrument according to the invention is characterized in that the front end ridge is formed at the front end of the clip leg, the front end ridge sequentially widening the back slit, lock hole, and middle slit of the shaft tube in their width directions when the knock member is inserted into the back part of the shaft tube in order to cause the clip leg to fit in the long hole of the shaft tube.

The knock-type writing instrument according to the invention is characterized in that a watering can-shaped notch is formed at the back end of the back slit.

The knock-type writing instrument according to the invention is characterized in that a fitting convex part, which is fitted in the back end of the refill inserted into the shaft tube, is formed at the front end of the knock member.

The knock-type writing instrument according to the invention is characterized in that a press control part having an anti-slip function operating during pressing the clip is provided on a surface of the clip.

Effects of the Invention

According to the knock-type writing instrument of the invention, the back end ridge is formed at the back end of the clip leg connecting the resilient piece of the knock member and the clip, so that, when the refills are exchanged, the middle and back slits of the shaft tube may be sequentially and smoothly widened in their width directions by a simple operation in which the clip is pushed out toward the back end of the shaft tube with the pressure greater than the bias force of the biasing member. This causes the clip leg to pass through the middle and back slits, so that the knock member may be easily removed from the back end of the shaft tube. This brings about an effect that the refills may be exchanged easily and effectively. In this manner, the back end ridge of the clip leg may easily widen the middle and back slits in their width directions during the refill exchange, such that the knock member does not need to be forcedly moved in a direction of removal from the back end of the shaft tube. This brings about an effect that the deformation of each of the slits, breakage of the shaft tube, etc., may be inhibited.

According to the knock-type writing instrument of the invention, the front end ridge is formed at the front end of the clip leg, so that the back and middle slits of the shaft tube may be sequentially and smoothly widened in their width directions also during insertion of the knock member into the back part of the shaft tube. This brings about an effect that the clip leg may be easily incorporated in the long hole.

According to the knock-type writing instrument of the invention, the watering can-shaped notch is formed at the back end of the back slit of the shaft tube, such that the clip leg may be smoothly pushed into the long hole. This brings about an effect that the knock member may be easily incorporated.

According to the knock-type writing instrument of the invention, the fitting convex part formed at the front end of the knock member is fitted in the back end of the refill in the shaft tube, such that the refill and knock member may be removed as one, thereby bringing about an effect that the refills may be more easily exchanged.

According to the knock-type writing instrument of the invention, the press control part provided on the surface of the clip has the anti-slip function, such that an operational force by a user pressing and moving the clip in the knock member removal direction during the knock member removal is easily transmitted to the clip and knock member. This improves operability for pressing and moving the clip, thereby bringing about an effect that the knock member may be more easily removed.

DETAILED DESCRIPTION

Embodiment 1

Figure 1:
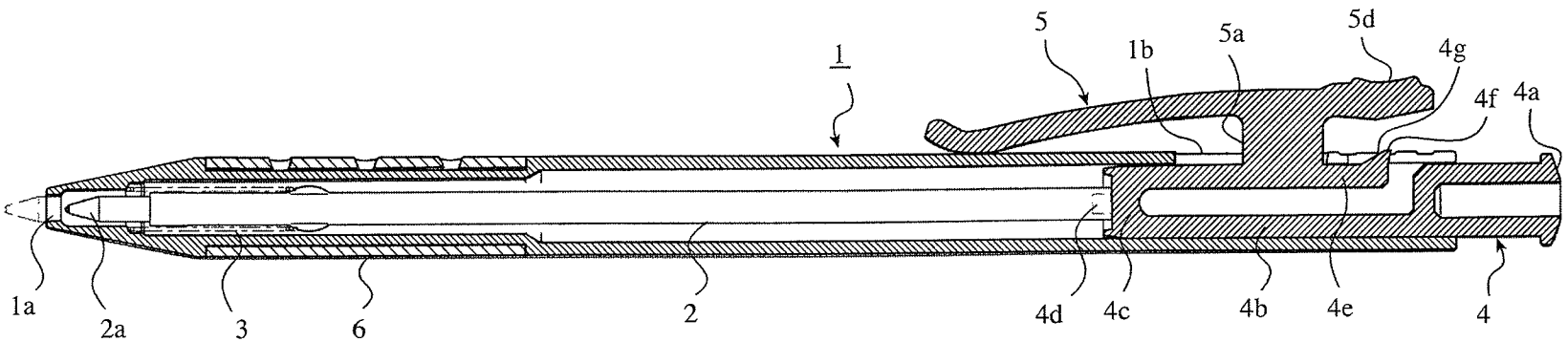
FIG. 1 is a cross-sectional view showing the knock-type writing instrument according to a first embodiment of the invention.
Figure 2:
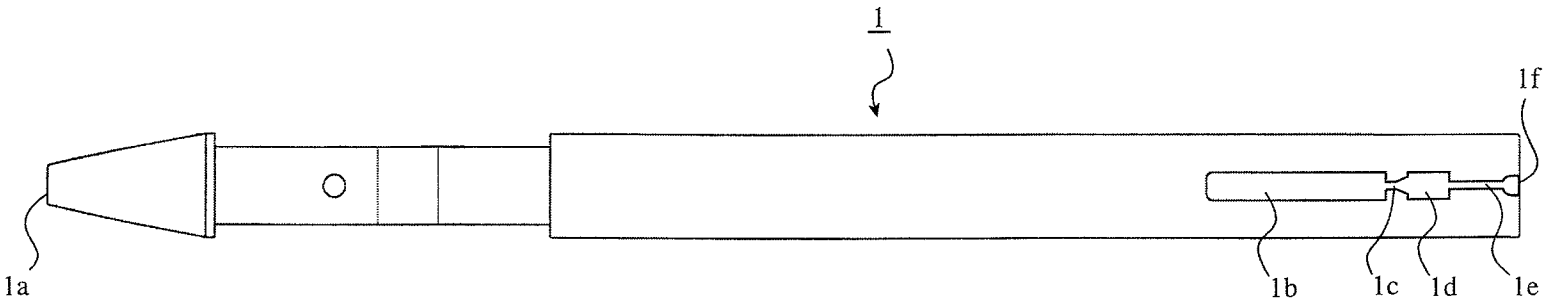
FIG. 2 is a plan view showing the shaft tube of FIG. 1.
Figure 3:
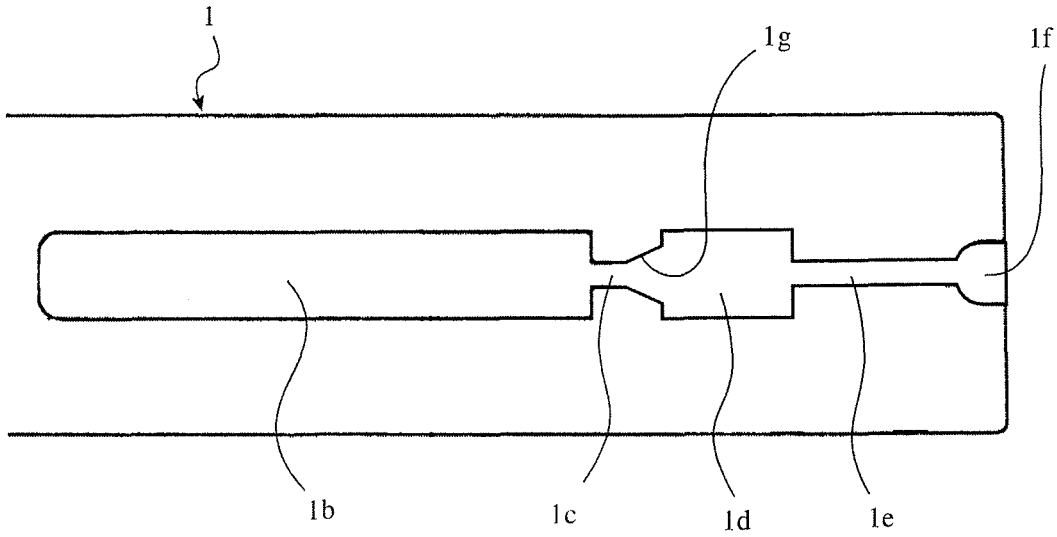
FIG. 3 is an enlarged plan view of the back part of the shaft tube of FIG. 2.
Figure 4:
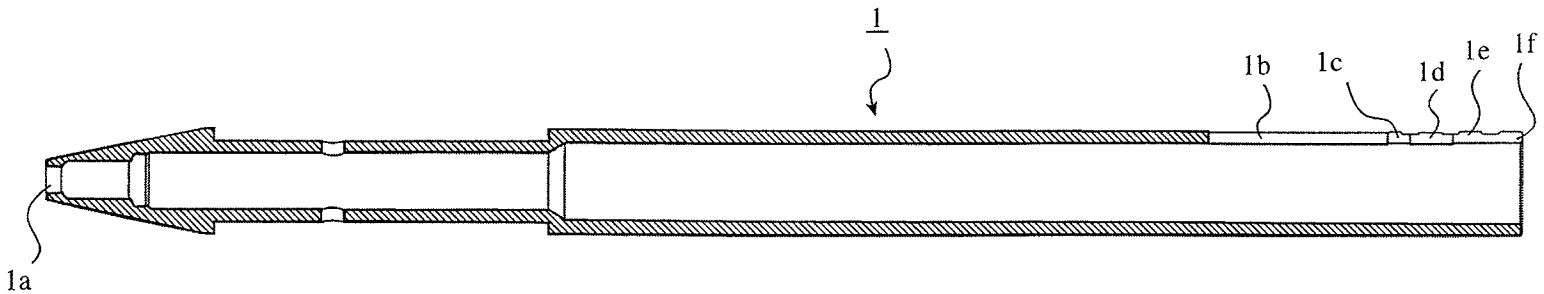
FIG. 4 is a cross-sectional view showing the entire shaft tube of FIG. 2.

FIG. 1 is a cross-sectional view showing the knock-type writing instrument according to Embodiment 1 of the invention; FIG. 2 is a plan view showing the shaft tube of FIG. 1; FIG. 3 is an enlarged plan view of the back part of the shaft tube of FIG. 2; and FIG. 4 is a cross-sectional view of the entire shaft tube of FIG. 2.

As shown in FIGS. 1 and 2, the knock-type writing instrument according to Embodiment 1 comprises: a shaft tube 1 having a port 1*a* provided at a front end thereof and an axially extending long hole 1*b* formed in a peripheral wall of a back part thereof; a ballpoint refill having a writing part 2*a* at a front end thereof, the refill being slidably inserted into the shaft tube from the back end of the shaft tube 1*a* in such a manner that the writing part 2*a* can be retractably projected from the front end of the shaft tube 1 via the port 1*a*; a return spring (biasing member) 3 provided in the shaft tube 1 for biasing the refill 2 in a retraction direction; a knock member inserted into the back part of the shaft 1 with a front end thereof being abutted on the back end of the refill 2 and with the back part thereof being protruded backward from the back end of the shaft tube 1; and a clip 5 connected to the knock member 4 and having a front part compressedly contracted with an outer circumferential surface of the shaft tube 1.

Figure 9A:
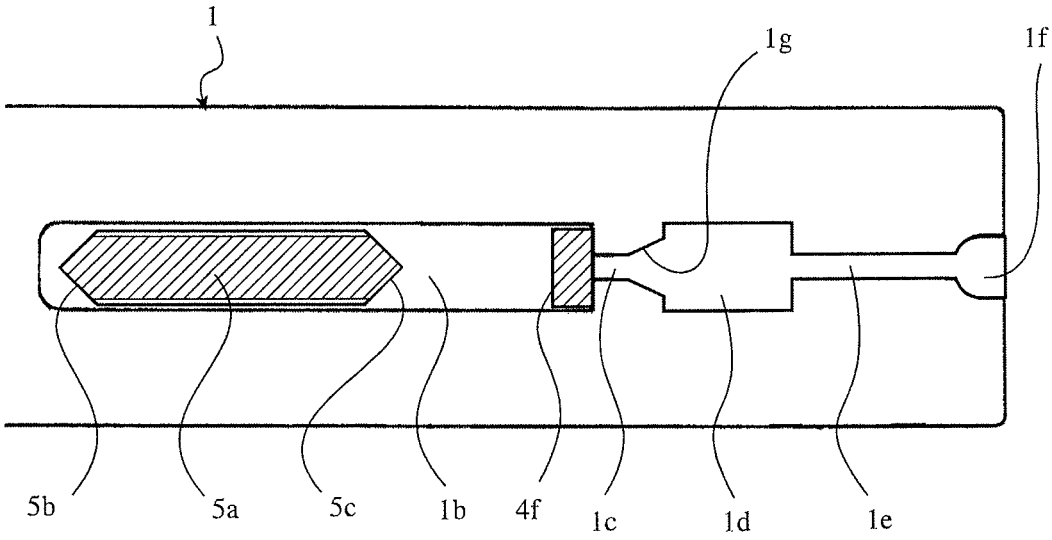
FIG. 9 is an operation diagram showing principal parts of the knock-type writing instrument of FIGS. 1-8.
Figure 9B:
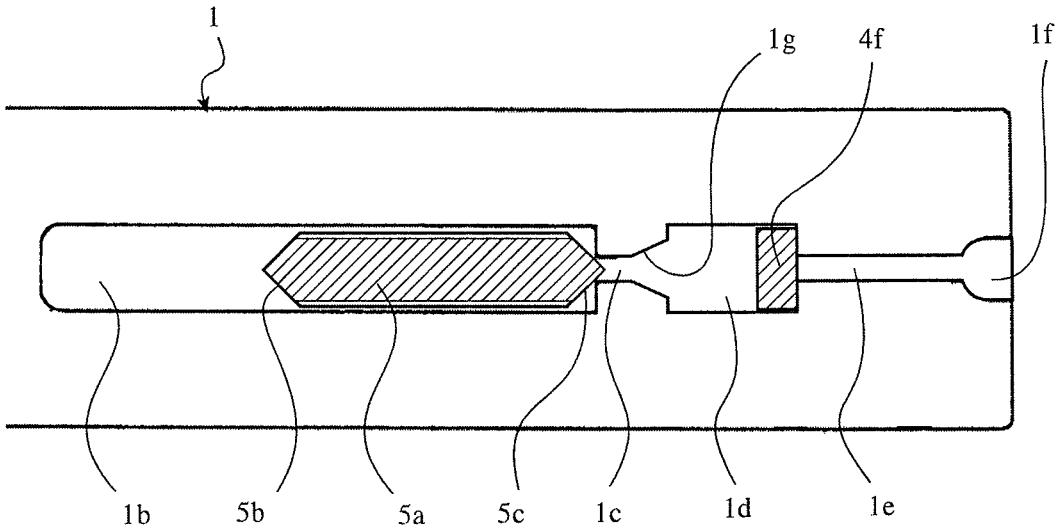

A more detailed configuration will be explained. As shown in FIGS. 2 and 3, the peripheral wall of the back part of the shaft tube 1 is formed with a lock hole 1 *d* continuously connected to a back end of the long hole 1*b* via a middle slit 1*c*, and a back slit 1*e* continuously extending to an edge of a back end of the shaft tube 1 from a back and of the lock tube 1*d* and opened backward. Incidentally, the long hole 1*b* has a first width, the lock hole 1 *d* has a second width substantially equal to the first width, the middle slit 1*c* has a third width smaller than each of the first and second widths, and the back slit 1*e* has a fourth width substantially equal to the third width. As best shown in FIGS. 9(*a*) and 9(*b*), a clip leg 5*a* of the clip 5 which will be discussed hereinafter has a thickness smaller then each of the first and second widths and larger than the third and fourth widths.

The long hole 1*b* is formed into a plane rectangular shape. The front end of the lock hole 1*d* is tapered, gradually narrowing toward the back end side of the middle slit 1*c*. A watering can-shaped notch 1*f* widening in a width direction is formed at the back end of the back slit 1*e*.

Figure 5:
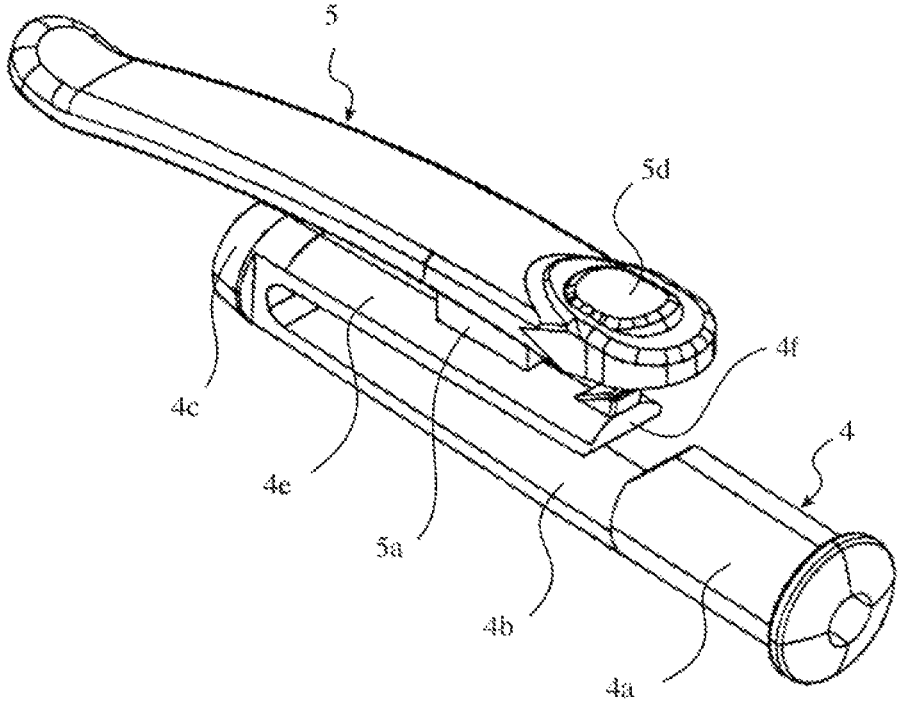
FIG. 5 is a perspective view showing the knock member and clip of FIG. 1.
Figure 6:
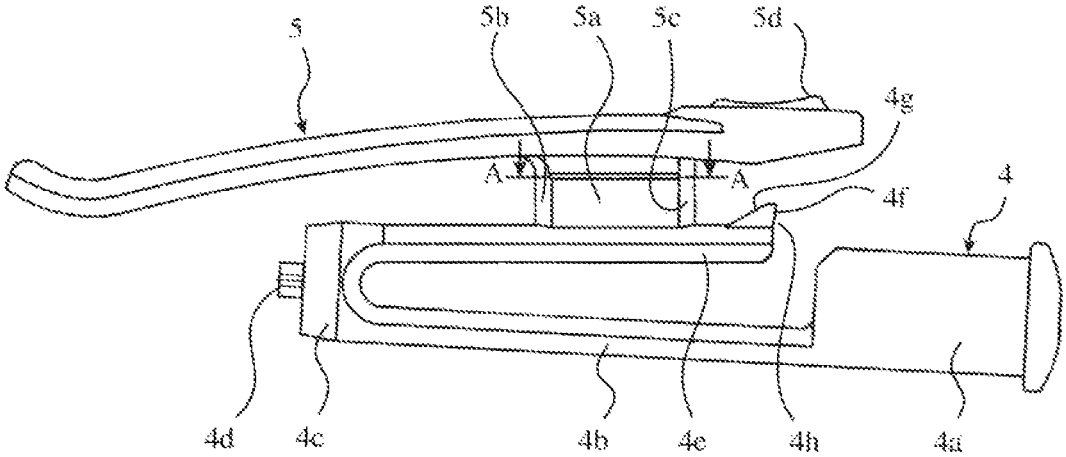
FIG. 6 is a side view of FIG. 5.
Figure 7:
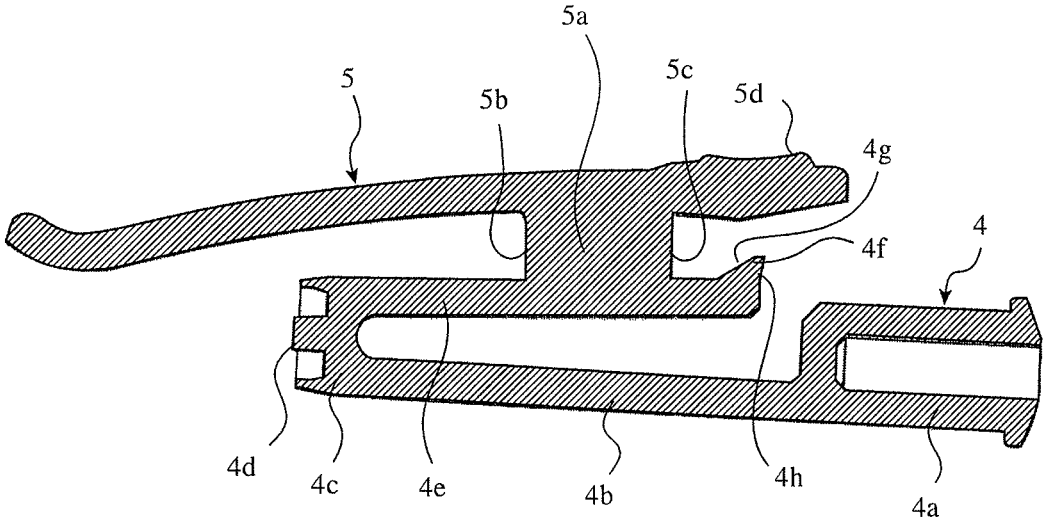
FIG. 7 is a cross-sectional view of FIG. 6.
Figure 8:
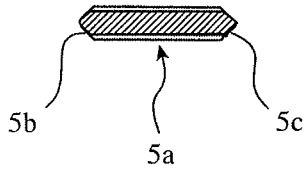
FIG. 8 is a cross-sectional view taken along line A-A in FIG. 6.

FIG. 5 is a perspective view showing the clip 5 integral with the knock member 4; FIG. 6 is a side view of FIG. 5; FIG. 7 is a cross-sectional view of FIG. 6; and FIG. 8 is a cross-sectional view taken along line A-A in FIG. 6.

As shown in these drawings, the knock member 4 is comprised of a cylindrical back end knock part 4*a*; a front extension 4*b* extending forward along an inner circumferential surface of the shaft tube 1 from the back end knock part 4*a*; the front end head 4*c* continuously formed at the front end of the front extension 4*b* to abut the back end of the refill 2 within the shaft tube 1; a fitting convex part 4*d* provided at a center of the front end face of the front end head 4*c* in a protruding manner to be fitted within the back end of the refill 2; a resilient piece 4*e* connected to the back end of the front end head 4*c* to extend backward in a direction substantially parallel to the front extension 4*b*, the resilient piece 4*e* capable of resiliently deforming in a radial direction of the shaft tube 1 and having the back end spaced apart from the front end of the back end knock part 4*a*; and a lock protrusion 4*f* integrally formed at the back end of the resilient piece 4*e* and facing outwardly in the radial direction of the shaft tube 1. A front surface of the lock protrusion 4*f* is formed as an inclined front surface 4*g* that is inclined from a tip of the lock protrusion 4*f* in an inner diameter direction of the shaft tube 1. An inclined and recurved surface 4*h* is formed at the back end of the lock protrusion 4*f* as shown in FIGS. 6 and 7. This inclined and recurved surface 4*h* acts as a lock surface with respect to the back ends of the long hole 1*b* and lock hole 1*d*, and is inclined in a direction of holding down (covering) outer edges at the back ends of the long hole 1*b* and lock hole 1*d* toward the inner diameter direction of the shaft tube 1.

At a substantially middle portion of the resilient piece 4*e* of the knock member 4 having such a configuration, the clip 5 is integrally formed via a clip leg orthogonal to the resilient piece 4*e*. The front end of the clip 5 is configured to be compressively contacted with the outer circumferential surface of the shaft tube 1 by a resilient force of the resilient piece 4*e*. As shown in FIGS. 6-8, a front end ridge 5*b* is formed at the front end of the clip leg 5*a* integrally connecting the resilient piece 4*e* of the knock member 4 and the clip 5, and a back end ridge 5*c* is formed at the back end of the clip leg 5*a*. The front end ridge 5*b* serves as a means to facilitate widening of the back slit 1*e* and middle slit 1*c* in this order in their respective width directions during incorporating the knock member 4 into the shaft tube 1 from behind. The back end ridge 5*c* serves to facilitate the widening of the middle slit 1*c* and back slit 1*e* in this order in their respective width directions during removal of the knock member 4. As best shown in FIGS. 8, 9(*a*) and 9(*b*), each of the front and back end ridges 5*b* , 5*c* is formed in a wedge-shape in cross-section.

The front end of the clip 5 is configured to be compressed into contact with or approach the outer circumferential surface of the shaft tube 1 by the resilient force of the resilient piece 4*e*. A press control part 5*d* forming a concave curved surface is formed on a surface at the back end of the clip 5, while a gripper 6 (see FIG. 1) comprising a resilient material such as rubber is fitted in a grip part of the shaft tube 1.

Next, the assembly and operation of the knock-type writing instrument according to this embodiment will now be described. FIGS. 9(*a*) and (*b*) are operation diagrams showing principal parts of the knock-type writing instrument.

First, the return spring 3 is fitted in the front end side of the refill 2, and then the refill 2 in this state is inserted into the shaft tube 1 from the back end of the shaft tube 1. When the front end ridge 5*b* of the clip leg 5*a* is then pushed into the back slit 1*e* from the notch 1*f* at the back end of the shaft tube 1 while inserting a side of the front end head 4*c* of the knock member 4 into the back part of the shaft tube 1, the front end ridge 5*b* intervenes in the back slit 1*e*, thereby widening the back slit 1*e*, lock hole 1*d*, and middle slit 1*c* in their respective width directions. This allows the clip leg 5*a* to pass through the back slit 1*e*, lock hole 1*d*, and middle slit 1*c* in this order to be fitted in the long hole 1*b*, such that the knock member 4 is incorporated in the back part of the shaft tube 1.

In such a process of incorporating the knock member 4, when the clip leg 5*a* is advanced along the back slit 1*e*, the inclined front surface 4*g* of the lock protrusion 4*f* at the back end of the resilient piece 4*e* of the knock member 4 slidingly comes into contact with an inner edge of the back slit 1*e*, thereby resiliently deforming the resilient piece 4*e* in the inner diameter direction of the shaft tube 1. Then, the lock protrusion 4*f* reaches the lock hole 1*d* through an underside region of the back slit 1*e*. At this point, the lock protrusion 4*f* rushes into the lock hole 1*d* by the resilient restoring force of the resilient piece 4*e*, and the back end of the lock protrusion 4*f* is locked to the back end of the lock hole 1*d* by a backward bias force of the return spring 3 (see FIG. 9(*b*)), such that the writing part 2*a* at the front end of the refill 2 is maintained in a withdrawn state within the shaft tube 1 (a nonuse state of the writing instrument). In this state, the fitting convex part 4*d* at the front end of the knock member 4 continues to be press fitted within the back end of the refill 2.

When the back end of the knock member 4 is knocked while the writing part 2*a* at the front end of the refill 2 is withdrawn within the shaft tube 1, the inclined front surface 4*g* of the lock protrusion 4*f* slidingly comes into contact with an inner edge of the middle slit 1*c*, such that the resilient piece 4*e* again resiliently deforms in the inner diameter direction of the shaft tube 1 to advance the lock protrusion 4*f*. When the lock protrusion 4*f* then passes through an underside region of the middle slit 1*c* in a direction of forward movement, the writing part 2*a* at the front end of the refill 2 protrudes from the front end of the shaft tube 1, and at the same time the lock protrusion 4*f* rushes into the long hole 1*b* by the resilient restoring force of the resilient piece 4*e*. Therefore, when knocking the back end of the knock member 4 is stopped at this point, the back end of the lock protrusion 4*f* is locked to the back end of the long hole 1*b* due to the backward bias force of the return spring 3 (see FIG. 9(*a*)). This maintains the refill 2 in a writable state with the writing part 2*a* at its front end protruding from the front end of the shaft tube 1.

When a back surface of the clip 5 is pressed toward the shaft tube 1 from such a writable state, the resilient piece 4*e* resiliently deforms via the clip leg 5*a* in the inner diameter direction of the shaft tube 1. Thus, the lock protrusion 4*f* at the back end of the resilient piece 4*e* moves away from a position in which it is locked to the back end wall of the long hole 1*b*, in the inner diameter direction of the shaft tube 1, releasing the lock of the back end of the lock protrusion 4*f* to the long hole 1*b*, and retracting the refill 2 and knock member 4 together by the backward bias force of the return spring 3 to withdraw the writing part 2*a* within the shaft tube 1. At the same time, the lock protrusion 4*f* moves to the lock hole 1*d* to lock the back end of the lock protrusion 4*f* to the back end of the lock hole 1*d*. Thus, the writing part 2*a* is maintained in the withdrawn state within the shaft tube 1.

The exchange of the refill 2 will now be explained.

If the press control part 5*d* at the back end of the clip 5 is pressed to push the clip 5 toward the back end of the shaft tube 1 when the refill 2 is exchanged while the writing part 2*a* at the front end of the refill 2 protrudes from the front end of the shaft tube 1, i.e., the back end of the lock protrusion 4*f* is locked to the back end of the long hole 1*b*, the lock of the back end of the lock protrusion 4*f* to the back end of the long hole 1*b* is released. At the same time, the back end ridge 5*c* of the clip leg 5*a* sequentially intervenes in the middle slit 1*c* and back slit 1*e* to widen these middle and back slits 1*c*, 1*e* in their respective width directions while sequentially passing the clip leg 5*a* through the middle slit 1*c* and back slit 1*e*. This allows the clip leg 5*a* to exit the back slit 1*e* backward to remove the knock member 4. Since the fitting convex part 4*d* of the knock member 4 is press fitted within the back end of the refill 2, the refill 2 as well as the knock member 4 is drawn from the shaft tube 1 backward.

After the refill 2 drawn from within the shaft tube 2 in this way is replaced with a new refill and the new refill 2 is inserted into the shaft tube 1 from the back end of the shaft tube, the knock member 4 is inserted into the shaft tube 1 from the back end of the shaft tube, thereby incorporating the knock member 4 in the back part of the shaft tube 1.

The above explains the exchange of the refill 2 while the writing part 2*a* protrudes from the front end of the shaft tube 1 and is kept in such a state. However, the refill 2 may be exchanged in a manner similar to the above even if the writing part 2*a* is withdrawn within the shaft tube 1 and kept in such a state.

According to this embodiment described above, the front and back end ridges 5*b* and 5*c* are formed at the respective front and back ends of the clip leg 5*a* integrally connecting the resilient piece 4*e* of the knock member 4 and the clip 5, and the clip leg 5*a* is configured to be slidably incorporated in the long hole 1*b* via the back slit 1*e*, lock hole 1*d*, and middle slit 1*c* in sequence from the back end of the shaft tube 1. Therefore, when the knock member 4 is inserted and incorporated in the back part of the shaft tube 1, the front end ridge 5*b* of the clip leg 5*a* sequentially widens the back slit 1*e* and middle slit 1*c* in their respective width directions, such that the clip leg 5*a* may easily pass through the back slit 1*e* and middle slit 1*c*. This allows the clip leg 5*a* to be easily incorporated in the long hole 1*b*. This brings about an effect that the assembly of the knock member 4 to the back part of the shaft tube 1 may be easy.

A watering can-shaped notch if wider than a width of the back slit 1*e* is formed at the back end of the back slit 1*e*. Further, an inclined hole 1*g* narrowing gradually toward the back end of the middle slit 1*c* is formed at the front end of the lock hole 1*d*. The inclined hole 1*g* connects the front end of the lock hole 1*d* and the back end of the middle slit 1*c*. This brings about an effect that the front end ridge 5*b* of the clip leg 5*a* may be more easily pushed into the back slit 1*e* and middle slit 1*c*, respectively.

During insertion of the knock member 4 into the back part of the shaft tube 1, the fitting convex part 4*d* provided at the center of the front end of the knock member 4 in a protruding manner is press fitted within the back end of the refill 2 inserted into the shaft tube 1. This brings about an effect that the refill 2 follows the knock member 4 during the removal of the knock member 4 for exchanging the refill 2, such that both of them may be removed integrally with a one-touch operation.

When the press control part 5*d* at the back end of the clip 5 is pressed to move toward the back end of the shaft tube 1 during the removal of the knock member 4, the lock of the lock protrusion 4*f* to the back end of the long hole 1*b* or lock hole 1*d* is released, and at the same time the back end ridge 5*c* of the clip leg 5*a* may easily widen the middle slit 1*c* and back slit 1*e* in their respective width directions. This brings about an effect that the removal of the knock member 4 may be also easily performed.

The press control part 5*d* has a concave curved surface to have an anti-slip function operating during a pressing operation. This brings about an effect that, during the removal of the knock member 4, the knock member 4 as well as the clip 5 may be easily pushed and moved toward the back end of the shaft tube 1 to be removed.

As described above, the widened watering can-shaped notch 1*f* is formed at the back end of the back slit 1*e*; the inclined hole 1*g* connects the front end of the lock hole 1*d* and the back end of the long hole 1*b*; and the front and back end ridges 5*b* and 5*c* are formed at the respective front and back ends of the clip leg 5*a*. This allows the front and back end ridges 5*b* and 5*c* of the clip leg 5*a* to easily widen the back slit 1*e* and middle slit 1*c* in their width directions with a slight operational force. This brings about an effect that the deformation of the back slit 1*e* or middle slit 1*c*, breakage of the shaft tube 1, etc., due to forced widening of the back slit 1*e* or middle slit 1*c* may be prevented.

When the back end of the knock member 4 is knocked, the inclined front surface 4*g* of the lock protrusion 4*f* slidingly comes into contact with the inner edge of the middle slit 1*c*.

This brings about an effect that the lock protrusion 4*f* may be passed under the middle slit 1*c* to smoothly pass through the middle slit 1*c*. Further, the inclined and recurved surface 4*h* formed at the back end of the lock protrusion 4*f* brings about an effect that the lock protrusion 4*f* under the bias force of the return spring 3 may surely engage the back end of the lock hole 1*d* or long hole 1*b*, and the engaging force is increased such that the refill 2 may be certainly held in a knocked position and in a withdrawn position within the shaft tube 1.

Embodiment 2

Figure 10:
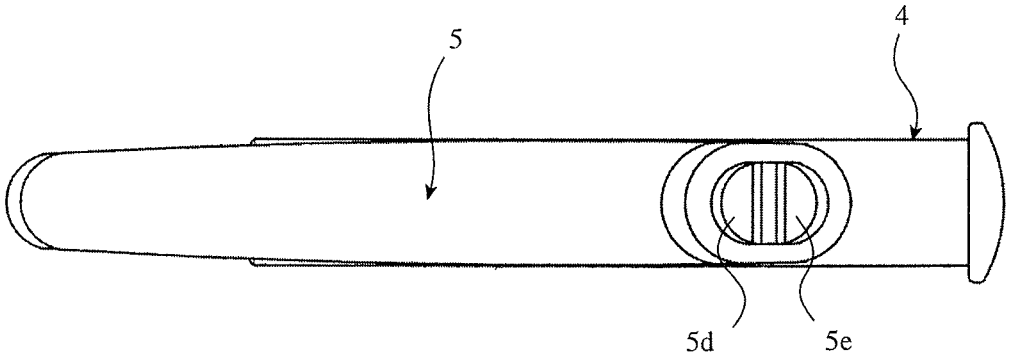
FIG. 10 is a plan view showing the clip of the knock-type writing instrument according to a second embodiment of the invention.
Figure 11:
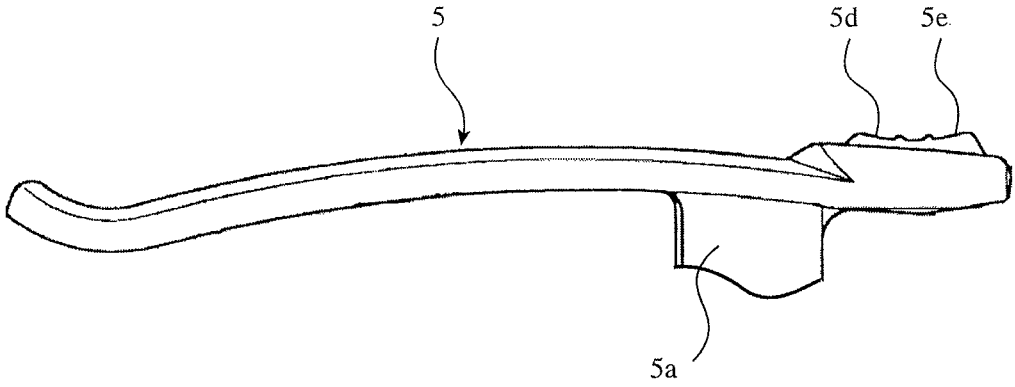
FIG. 11 is a side view of FIG. 10.

FIG. 10 is a plan view showing the clip of the knock-type writing instrument according to Embodiment 2 of the invention; and FIG. 11 is a side view of FIG. 10.

In this embodiment, an anti-slip rib 5*e* orthogonal to a longitudinal direction of the clip 5 is formed on a surface of the press control part 5*d* on the surface of the back end of the clip 5 in Embodiment 1 mentioned above. The rib 5*e* allows the press control part 5*d* to be easily pressed to move toward the back end of the shaft tube 1 during the removal of the knock member 4, bringing about an effect of improving its operability.

Embodiment 3

In the above Embodiment 1, the front and back end ridges 5*b* and 5*c* formed at the respective front and back ends of the clip leg 5*a* are explained. In the knock-type writing instrument according to the invention, the back end ridge 5*c* may be formed at only the back end of the clip leg 5*a*. Again, during the exchange of the refill 2, the back end ridge 5*c* may sequentially and smoothly widen the middle slit 1*c* and back slit 1*e* of the shaft tube 1 in their width directions by a simple operation in which the clip 5 is pushed out toward the back end of the shaft tube 1 with a pressure greater than the bias force of the return spring 3. This allows the clip leg 5*a* to pass through the middle slit 1*c* and back slit 1*e* to easily remove the knock member 4 from the back end of the shaft tube 1. This brings about an effect that the refill 2 may be easily and effectively exchanged. In this way, during the exchange of the refill 2, the back end ridge 5*c* may easily widen the middle slit 1*c* and back slit 1*e* in their width directions. Thus, the knock member 4 does not need to be forcedly moved in a direction of removal from the back end of the shaft tube 1. This brings about an effect of inhibiting the deformation of each of the slits 1*c*, 1*e*, breakage of the shaft tube 1, etc.

Embodiment 4

Figure 12:
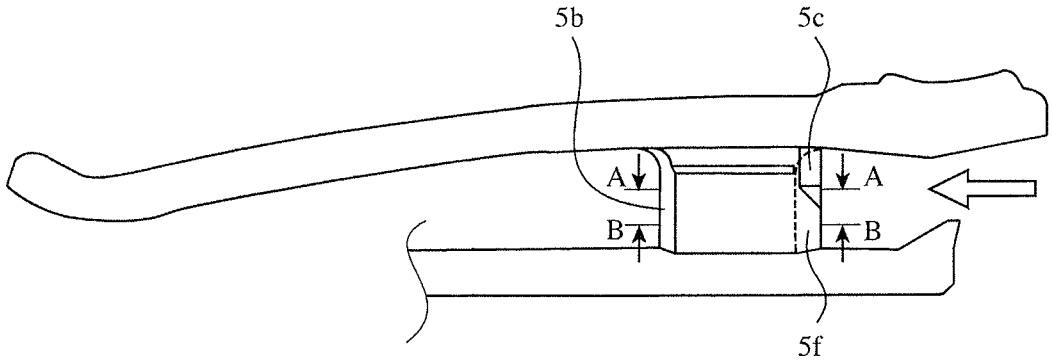
FIG. 12 is a side view of the knock member and clip according to another embodiment of the invention.
Figure 13:
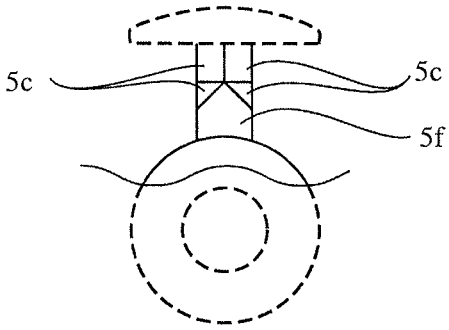
FIG. 13 is a view on arrow of FIG. 12.
Figure 14:
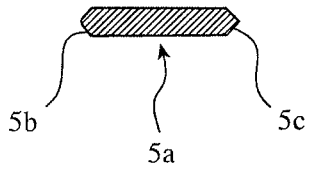
FIG. 14 is a cross-sectional view taken along line A-A in FIG. 12.
Figure 15:
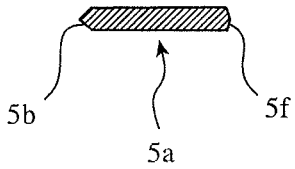
FIG. 15 is a cross-sectional view taken along line B-B in FIG. 12.

FIG. 12 is a side view of the knock member and clip according to Embodiment 4 of the invention; FIG. 13 is a view on arrow of FIG. 12; FIG. 14 is a cross-sectional view taken along line A-A in FIG. 12; and FIG. 15 is a cross-sectional view taken along line B-B in FIG. 12.

As with the above Embodiment 1, the front end ridge 5*b* is formed at the front end of the clip leg 5*a* as shown in FIGS. 12-15. However, Embodiment 4 differs from the above Embodiment 1 in the configuration of the back end ridge 5*c* formed at the back end of the clip leg 5*a*.

That is, the back end of the clip leg 5*a* has the back end ridge 5*c* formed in only its upper region, while its lower region has a planar wall 5*f* without the back end ridge 5*c*.

According to this embodiment, when the writing instrument is not used (see FIG. 9(*b*)), the back end of the lock protrusion 4*f* is locked to the back end of the lock hole 1*d* by the backward bias force of the return spring 3, such that the writing part 2*a* at the front end of the refill 2 is maintained in the withdrawn state within the shaft tube 1. Even if the lock of the back end of the lock protrusion 4*f* to the back end of the lock hole 1*d* is released by some unnecessary external force acting in this state, the lower region at the back end of the clip leg 5*a* formed into the planar wall 5*f* without the back end ridge 5*c* does not easily widen the middle slit 1*c* and back slit 1*e* in the respective width directions. This brings about an effect of preventing the knock member 4 from moving backward and being separated.

In the refill exchange, when the press control part 5*d* at the back end of the clip leg 5*a* is pressed to move toward the back end of the shaft tube 1, the lock of the lock protrusion 4*f* to the back end of the lock hole 1*d* is released, and at the same time the back end ridge 5*c* formed in only the upper region of the clip leg 5*a* may easily widen the middle slit 1*c* and back slit 1*e* in respective width directions. This may be securely and smoothly performed only during the refill exchange.

Accordingly, the back end ridge 5*c* of the clip leg 5*a* functions only during the refill exchange, while the rest of the time, the function of the planer wall 5*f* of the clip leg 5*a* brings about an effect of preventing the knock member 4 from being separated carelessly.

PARTS LIST

1 shaft tube
1*a* core delivering port
1*b* long hole
1*c* middle slit
1*d* lock hole
1*e* back slit
1*f* notch
1*g* inclined hole
2 refill
2*a* writing part
3 return spring (biasing member)
4 knock member
4*a* back end knock part
4*b* front extension
4*c* front end head
4*d* fitting convex part
4*e* resilient piece
4*f* lock protrusion
4*g* inclined front surface
4*h* inclined and recurved surface
5 clip
5*a* clip leg
5*b* front end ridge
5*c* back end ridge
6 gripper A knock-type writing instrument is described comprising: a shaft tube 1 having a long hole 1*b*; a refill 2 inserted into the shaft tube 1; a biasing member 3 biasing the refill 2 backward; a knock member 4 inserted into a back part of the shaft tube 1; a resilient piece 4*e* connected to the front end of the knock member 4 to extend backward and capable of resiliently deforming in a radial direction of the shaft tube 1; a lock protrusion 4*f* formed at the back end of the resilient piece 4*e*; and a clip 5 having a clip leg 5*a* connected to the resilient piece 4*e* to be slidably fitted in the long hole 1*b*, the clip having a front part compressed into contact with or approaching an outer circumference of the shaft tube 1, wherein a lock hole 1*d* connected to the back end of the long hole 1*b* via a middle slit 1*c* as well as a back slit 1*e* connected to the back end of the lock hole 1*d* to reach the back end of the shaft tube 1 are continuously formed on a back peripheral wall of the shaft tube 1 in an extension direction of the back end of the long hole 1*b*; and wherein the back end ridge 5*c* is formed at the back end of the clip leg 5*a*, the back end ridge sequentially widening the middle slit 1*c* and back slit 1*e* in their width directions by pushing out the clip 5 toward the back end of the shaft tube 1 with a pressure greater than a bias force of the biasing member 3.

It will be readily apparent, however, that other variations and modifications are possible within the intended ambits of the following claims:

The invention claimed is:

1. A knock-type writing instrument comprising:

a shaft tube formed in a peripheral wall of a back part thereof with an axially extending long hole, a lock hole continuously connected to a back end of the long hole by a middle slit, and a back slit continuously extending to an edge of a back end of the shaft tube from a back end of the lock hole and opened backward;

the long hole having a first width, the lock hole having a second width substantially equal to the first width, the middle slit having a third width smaller than each of the first and second widths, and the back slit having a fourth width substantially equal to the third width;

a refill having a writing part provided at a front end thereof and inserted into the shaft tube from the back end of the shaft tube;

a biasing member provided in the shaft tube for biasing the refill backward;

a knock member having a resilient piece capable of resiliently deforming in a radial direction of the shaft tube, the resilient piece being connected to a front end of the knock member and extending backward, and a lock protrusion formed on a back end of the resilient piece; and a clip having a clip leg which extends orthogonally to the clip and is connected between the clip and the resilient piece of the knock member, so that the clip is integrated with the knock member via the clip leg;

the knock member integrated with the clip being mounted with respect to the shaft tube in such a manner that the knock member is slidably inserted in the back part of the shaft tube with the front end thereof being abutted on a back end of the refill, with the lock protrusion thereof being releasably engaged with the back end of the lock hole, and with the back end thereof being protruded backward from the back end of the shaft tube, and the clip is arranged laterally of the shaft tube with the clip leg thereof being slidably fitted through the long hole of the shaft tube;

wherein the clip leg is provided at a back end thereof with a back ridge for facilitating sequential widening of the middle and back slits in width directions of the middle and black slits when the clip is pushed in a backward direction of the shaft tube in order that the knock member integrated with the clip is removed from the back end of the shaft tube, said back ridge being formed in a wedge-shape in cross-section.

2. The knock-type writing instrument as recited in claim 1, wherein the clip leg is further provided at a front end thereof with a front ridge for facilitating the sequential widening of the middle and back slits in the width directions of the middle and back slits when the knock member integrated with the clip is inserted into the back part of the shaft tube in order that the knock member integrated with the clip is mounted with respect to the back end of the shaft tube with the clip leg being slidably fitted through the long hole of the shaft tube.

3. The knock-type writing instrument as recited in claim 1, wherein a watering can-shaped notch is formed at a back end of the back slit.

4. The knock-type writing instrument as recited in claim 1, wherein the knock member is provided at the front end thereof with a fitting convex part, which is fitted in the back end of the refill.

5. The knock-type writing instrument as recited in claim 1, wherein the clip is provided on a surface thereof with a press control part having an anti-slip function during pressing operation of the clip.

6. The knock-type writing instrument as recited in claim 2, wherein the front ridge is formed in wedge shape in cross-section.

* * * * *